US006899162B2

(12) United States Patent
Hohl et al.

(10) Patent No.: US 6,899,162 B2
(45) Date of Patent: May 31, 2005

(54) DEVICE FOR COOLING AND HEATING A MOTOR VEHICLE

(75) Inventors: Reiner Hohl, Stuttgart (DE); Manfred Schmitt, Heppenheim (DE); Karsten Mann, Stuttgart (DE); Oliver Kaefer, Murr (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/450,986

(22) PCT Filed: Jul. 18, 2002

(86) PCT No.: PCT/DE02/02625

§ 371 (c)(1),
(2), (4) Date: Jun. 18, 2003

(87) PCT Pub. No.: WO03/016690

PCT Pub. Date: Feb. 27, 2003

(65) Prior Publication Data

US 2004/0050544 A1 Mar. 18, 2004

(30) Foreign Application Priority Data

Jul. 20, 2001 (DE) ..... 101 34 678

(51) Int. Cl.[7] ..... B60H 3/00

(52) U.S. Cl. ..... 165/41; 165/51; 165/140; 123/41.29

(58) Field of Search ..... 62/244, 323.1, 62/323.2; 165/41, 42, 51, 140; 123/41.1, 41.29

(56) References Cited

U.S. PATENT DOCUMENTS 5,201,285 A 4/1993 McTaggart
5,215,044 A 6/1993 Banzhaf et al.
5,251,588 A 10/1993 Tsujii et al.
5,531,285 A 7/1996 Green
6,227,153 B1 * 5/2001 Till ..... 123/41.12
6,244,256 B1 * 6/2001 Wall et al. ..... 123/568.12
6,308,664 B1 * 10/2001 Ambros ..... 123/41.12
6,457,324 B2 * 10/2002 Zeigler et al. ..... 62/406
6,554,088 B2 * 4/2003 Severinsky et al. ..... 180/65.2
6,601,545 B1 8/2003 Hohl
6,637,468 B1 * 10/2003 Wu ..... 141/7

FOREIGN PATENT DOCUMENTS

DE 34 42 350 A1 6/1986
DE 199 60 960 C1 4/2001
EP 0 841 735 A1 5/1998
JP 59215915 A * 12/1984
WO 01/34952 A1 5/2001

OTHER PUBLICATIONS

Special Edition of the Automobility Technischen Zeitung (ATZ) (Automotive Engineering Journal) and Motortechnischen Zeitung (MTZ) (Engine Design Journal), May 1998, pp. 44, 46.

* cited by examiner

*Primary Examiner*—William E. Tapolcai
*Assistant Examiner*—Mohammad M. Ali
(74) *Attorney, Agent, or Firm*—Michael J. Striker

(57) ABSTRACT

The current invention relates to an apparatus for cooling and/or heating a motor vehicle, with at least one coolant pump for circulating a coolant in a cooling and heating system, with a main cooler segment, which has a main cooler inlet and a main cooler outlet, wherein the main cooler inlet is at least intermittently connected to at least one coolant outlet of an engine to be cooled, in particular an internal combustion engine, of the vehicle, and its main cooler outlet is connected to at least one coolant inlet of the engine, and with at least one other, secondary cooler segment provided in addition to the main cooler segment and at least one other unit to be cooled, which is connected to the cooling and heating system, and the apparatus have at least one bypass line with a bypass valve, which is associated with the at least one secondary cooler segment and is disposed parallel to this secondary cooler segment in the cooling and heating system of the motor vehicle.

26 Claims, 5 Drawing Sheets

DEVICE FOR COOLING AND HEATING A MOTOR VEHICLE

BACKGROUND OF THE INVENTION

The current invention relates to an apparatus for cooling and/or heating a motor vehicle.

In modern vehicles, various units secondary to the engine are used, which are referred to below as units or secondary units. Such secondary units can be electric machines such as starters or generators, or also oil coolers and air conditioning compressors. In many cases, it is necessary to cool the secondary units in a manner similar to that of the engine.

On the other hand, the significantly increased efficiency of modern engines, for example direct injecting diesel engines, places ever increasing limits on the amount of heat generated by the internal combustion engine that remains available for other uses in the cooling and heating system of the vehicle. In some operating states of an engine, for example in the case of a cold start, when used for short trips, or even when the vehicle is traveling down long descents, the amount of heat input into the cooling water, which heat can be supplied by the engine itself, is no longer sufficient. As a result, the engine and its catalytic converter do not reach the optimal operating temperatures in the available amount of time, which leads to increased fuel consumption and exhaust emissions.

Since modern internal combustion engines, in particular the above-mentioned diesel engines, have become so efficient that they no longer generate enough thermal output to heat the vehicle interior or to de-ice the vehicle windows when temperatures outside are low, it is becoming more and more common to use secondary heaters, which are integrated into the cooling and heating circuit of the vehicle in order to impart additional heat to the cooling water in certain operating states of the engine.

Secondary heaters of this kind are either electrically operated or burn fuel (chemical secondary heaters) in order to generate the necessary heat. These secondary heaters are quite expensive and also have the disadvantage that they must be installed in the generally cramped engine compartment of a motor vehicle and therefore incur costs that are not insignificant.

For these reasons, it has been proposed to use heat sources that are already present in the vehicle system as additional secondary heaters for the cooling and heating system of the motor vehicle.

EP 08 41 735 A1 has disclosed a water-cooled alternating current generator or three-phase current-generator, which is used in motor vehicles and whose cooling jacket is integrated into the cooling water circuit of the internal combustion engine. The water flowing through the cooling jacket of this electric machine makes it possible to very effectively dissipate the impermissible dissipated energy of the generator. Moreover, there is the advantage that by contrast with air-cooled generators, this dissipated energy is not lost, but can be dissipated into the cooling water or a heating system by means of a heat exchanger and is consequently available for improving the thermal output.

DE 34 42 350 C2 has disclosed a heat exchanger system for heating a street vehicle with an electric drive motor. The power electronics, which are used to control the drive motor and which give off heat during driving operation, are provided with apparatuses for liquid cooling. The cooling connections of these apparatuses are connected by means of a closed conduit system to a pump and a heating system, which can dissipate heat into the interior of the vehicle. As a result, the heat dissipated by the power semiconductors via the heat sinks can be supplied to the heating system.

One main problem in imparting dissipated energy from electronic power semiconductors, for example also from starters or generators, into the cooling circuit of a vehicle lies in preventing the permissible component temperature of the semiconductor elements from being exceeded when cooling water temperatures are high.

DE 199 60 960 C1 has disclosed a heat exchanger system for a vehicle with an internal combustion engine and an electric motor, whose motor cooling circuit is equipped with a mechanical water pump and whose electronics cooling circuit is equipped with an electric water pump. The two cooling circuits are coupled to each other by means of connecting lines that can be opened and closed so that the heat, which is dissipated by the power electronics by means of the cooling water, can be used to heat the cooling water and therefore to heat the passenger compartment by means of the heating system heat exchanger.

The heat exchanger system disclosed in DE 199 60 960 C1 is very costly and complex so that in addition to the increased susceptibility of this system, its high costs must also be viewed as a non-negligible disadvantage.

A special edition of the Automobiltechnischen Zeitung (ATZ) [automotive engineering journal] and Motortechnischen Zeitung (MTZ) [engine design journal] from May 1998 disclosed a heating and cooling concept for a motor vehicle in which the water cooler of the system is serially divided into a high-temperature and low-temperature section. This division of the cooler enables two different flow speeds to be achieved. By installing a dividing wall in the water tank of the cooler, approximately 20% of the cooler wetting surface in the lower region of the cooler is used to produce a low-temperature section. A throttled coolant flow in the low-temperature region produces almost twice the temperature cooling rate as in the upper cooler region, which, due to its higher flow speed, only achieves a temperature reduction of approximately 7 degrees Celsius when used for cooling.

SUMMARY OF THE INVENTION

The claimed apparatus according to the invention, which is for cooling and/or heating a motor vehicle, has the advantage over the prior art that the heat dissipation into the associated cooler segment can be regulated as needed by means of the at least one bypass line and the associated bypass valve, which are associated with at least one secondary cooler segment and are situated in parallel to this secondary cooler segment in the cooling and heating system of the motor vehicle. The bypass valve and the associated bypass line make it possible to bypass the cooler as needed. As a result, the full of thermal output of the secondary unit, for example a generator or starter, can be used to accelerate the warming up of the engine and to increase the thermal output of the system.

According to a preferred embodiment of the apparatus according to the invention, at least one first unit to be cooled is connected to the cooling and heating system of the motor vehicle by means of a secondary cooler segment. Through the use of this secondary cooler segment, which functions as a secondary cooler, the first unit to be cooled can be operated at a temperature that differs from the engine temperature level. It is therefore possible, for example, to cool a first unit to a temperature significantly lower than the engine temperature.

Because the cooling system according to the invention includes a provision that at least one second unit to be cooled is connected in parallel to the engine and/or the main cooler segment, this unit can be cooled without requiring an additional coolant pump. This makes it possible to assure that no coolant heated by the engine is supplied to the unit and no coolant heated by the unit is supplied to the engine.

In particular, the second unit to be cooled, i.e. a unit connected in parallel with the engine and/or with the main cooler segment, can also be a first unit to be cooled, i.e. can also be connected to the cooling and heating system of the motor vehicle by means of a secondary cooler segment. In this regard, the discussion below will refer to a first unit and a second unit, which terms do not represent any sequence, but are merely intended to distinguish the manner in which a secondary unit is installed in the cooling and heating circuit according to the invention, which is part of a motor vehicle.

Preferably, the volumetric flow and/or the temperature of the coolant, which is pumped through at least one first unit and/or at least one second unit, can be varied by means of at least one valve in the supply line of the at least one first unit and/or the at least one second unit. In one embodiment of the apparatus according to the invention, this at least one valve can be embodied in the form of a thermostatic valve, in particular a mixing valve.

According to a particularly preferable embodiment, this at least one valve is a regulated mixing valve disposed in the supply line of the at least one first unit and/or the at least one second unit. This valve makes it possible to regulate the coolant flow through a first unit and a second unit as needed. It is thus possible to exert the smallest load possible on the water pump and thus to minimize the pump capacity. Since the cooling capacity required by an internal combustion engine and for example an electric machine (starter, generator, etc.) fluctuate to a considerable degree independently of each other, the components that have lower coolant requirements would have far too much coolant circulating through them. In order to prevent this, for example a regulated three-way valve can be used, which is used as needed to distribute the volumetric flow supplied by the water pump to the internal combustion engine and the electric machine.

Such a measure also makes it possible for the first unit to be operated at significantly lower temperatures than the internal combustion engine, within a defined second temperature range. The presence of such a second defined temperature range (temperature subsystem) can be advantageous, for example, if the first unit is comprised of a power electronics circuit associated with a starter generator, for example, and the second unit is a starter generator of this kind. In this case, it is possible to operate a starter generator in a temperature range that is comparable to that of the internal combustion engine, while the associated power electronics circuit can be operated at a significantly lower temperature. This makes it possible to prevent the power electronics components from being thermally overloaded or otherwise negatively influenced.

In another advantageous embodiment of the apparatus according to the invention, the valves disposed in the supply lines to the units are actuated as a function of the temperature detected by a temperature sensor. To that end, it is possible for a control unit to be a component of the apparatus and for this control unit to actuate the regulatable or controllable valves in accordance with a comparison value or reference value stored in the control unit itself, for example.

If the first unit is comprised of a power electronics circuit or another type of circuit, it is also possible, for example, to integrate the control and/or regulating unit directly into this circuit.

In addition to the sensor signals supplied by a temperature sensor, it is also possible for there to be other sensors signals for controlling or regulating the supply line valves with the aid of a control unit or a corresponding control and/or regulating circuit. Thus the apparatus according to the invention can, for example, contain additional sensors for the pressure, the through flow volume, or other useful parameters of the coolant.

In one advantageous embodiment of the cooling system according to the invention, the delivery capacity of the coolant pump can be regulated or controlled independent of the engine speed. In particular, it is possible to use an electric coolant pump. The delivery capacity of the coolant pump of the apparatus according to invention can be advantageously regulated or controlled by the control unit through the use of one of the sensor signals, in particular a temperature signal. It is also advantageous that both the coolant pump and the corresponding regulating valves in the supply lines of the secondary units can be controlled directly on the basis of known or currently detected status variables of the unit, for example the current dissipated energy or a load profile.

In one advantageous embodiment of the cooling system according to the invention, the cooling capacity of the main cooler segment and of the available secondary cooler segments can be increased by virtue of the fact that one or more cooling fans are associated with, the main cooler segment and/or the secondary cooler segments that provided. The system parameters detected by the control unit can be advantageously taken into account in the control or regulation of this at least one cooling fan.

In a particularly advantageous embodiment of the heating and cooling system according to the invention, the main cooler segment and the at least one secondary cooler segment are structurally integrated into a combined cooling module. This integrated design permits the cooling module to be incorporated into the engine compartment of the motor vehicle in a space-saving, compact manner.

In a cooling system according to the invention, it is possible for the combined cooling module to have a shared inlet for the cooler segments that it contains. This permits the cooler segments integrated into the combined cooling module to be simply and advantageously situated parallel to one another in the cooling and heating system. This parallel segmentation of the vehicle cooler permits different temperature subsystems to be produced in a simple way in the heating and cooling system of the vehicle. For the latter configurations of the cooling and heating system, the coolant pump can be advantageously integrated into the cooling and heating system of the vehicle in such a way that it forces the coolant through the cooling module. This makes it possible for an apparatus according to the invention to have only a single coolant pump, which supplies all of the partial cooling circuits (temperature subsystems) simultaneously, even when there are different temperature levels in these partial cooling circuits.

In another advantageous embodiment of the apparatus according to invention, the combined cooling module has separate inlet conduits and separate outlet conduits for the individual cooler segments that it contains. Preferably, at least one secondary cooler segment has at least one secondary cooler inlet, which is connected to the pressure side of the coolant pump. This measure can assure that the coolant pump, which is present anyway, generates the necessary volumetric flow of coolant. This makes it advantageously possible to realize one embodiment of the apparatus according to the invention in which an additional coolant pump can be eliminated. The placement of the at least one secondary cooler inlet on the pressure side of the coolant pump assures that the coolant flows through the secondary cooler with a sufficient amount of pressure. For the same reason, in embodiments in which at least one additional second unit is provided, this second unit should be advantageously connected to the pressure side of the coolant pump.

A particularly advantageous embodiment of the apparatus for heating and cooling a motor vehicle according to the invention is produced if the combined cooling module and the bypass valves, which regulate the flow through the respective segments of this cooling module, are integrated into a combined cooler module. This produces a compact, modular cooling module, which can easily take into account different requirements, such as a different number of thermal subsystems in the cooling circuit.

In the cooling system according to the invention, at least two components or units are to be advantageously connected in series. This makes it is possible under certain operating conditions to use the waste heat of one component to heat another component. The waste heat of the cylinder head of the engine, for example, can be used to more rapidly heat the oil during the warm-up phase of the engine. If this series connection of individual components contained in the cooling and heating circuit is to be disconnected again or at least partially disconnected again, for example during normal driving operation, then a four-way mixing valve can be advantageously integrated into the coolant circuit.

If the at least one coolant inlet of the engine can be closed by means of a valve, for example, as in the apparatus claimed by the invention, then this makes it possible to further reduce the required coolant flow when the engine is not running.

Alternatively, the waste heat of a unit, which is integrated into the coolant circuit, or of another component can be used alternatively to heat either the engine or the passenger compartment. In particular, this makes it possible to produce an auxiliary heating unit.

In the cooling system according to the invention, the first unit can be an electrical circuit, which makes it necessary to operate this circuit in a temperature range significantly lower than that of the internal combustion engine. In one particularly preferred embodiment of the cooling system according to the invention, the first unit is a power electronics circuit, which is associated for example with a generator, a starter, an (additional) electric drive motor, or a starter generator, which in this case represents the second unit. Starter generators combine the functions of conventional starters and conventional dynamos or generators. Starter generators are powerful heat sources and must therefore be cooled in many cases. Since they can operate at temperatures that correspond to the temperatures of the coolant for cooling the internal combustion engine, it is particularly advantageous to connect them in parallel with the engine and/or the main cooler. The coolant temperatures usually used to cool internal combustion engines, however, are too high as a rule for the associated power electronics. It is therefore particularly advantageous if the power electronics circuit associated with the for example one starter generator is connected to the cooling and heating system of the motor vehicle by way of a secondary cooler segment. This allows the power electronics circuit to operate in a temperature range that is significantly lower than the temperature of the coolant used to cool the engine.

On the other hand, as described above, the waste heat generated by the power electronics circuit, a starter, or a generator can be advantageously used to rapidly heat other components contained in the coolant circuit, for example the engine itself.

DESCRIPTION OF THE PREFERRED EMBODIMENTS

Figure 1:
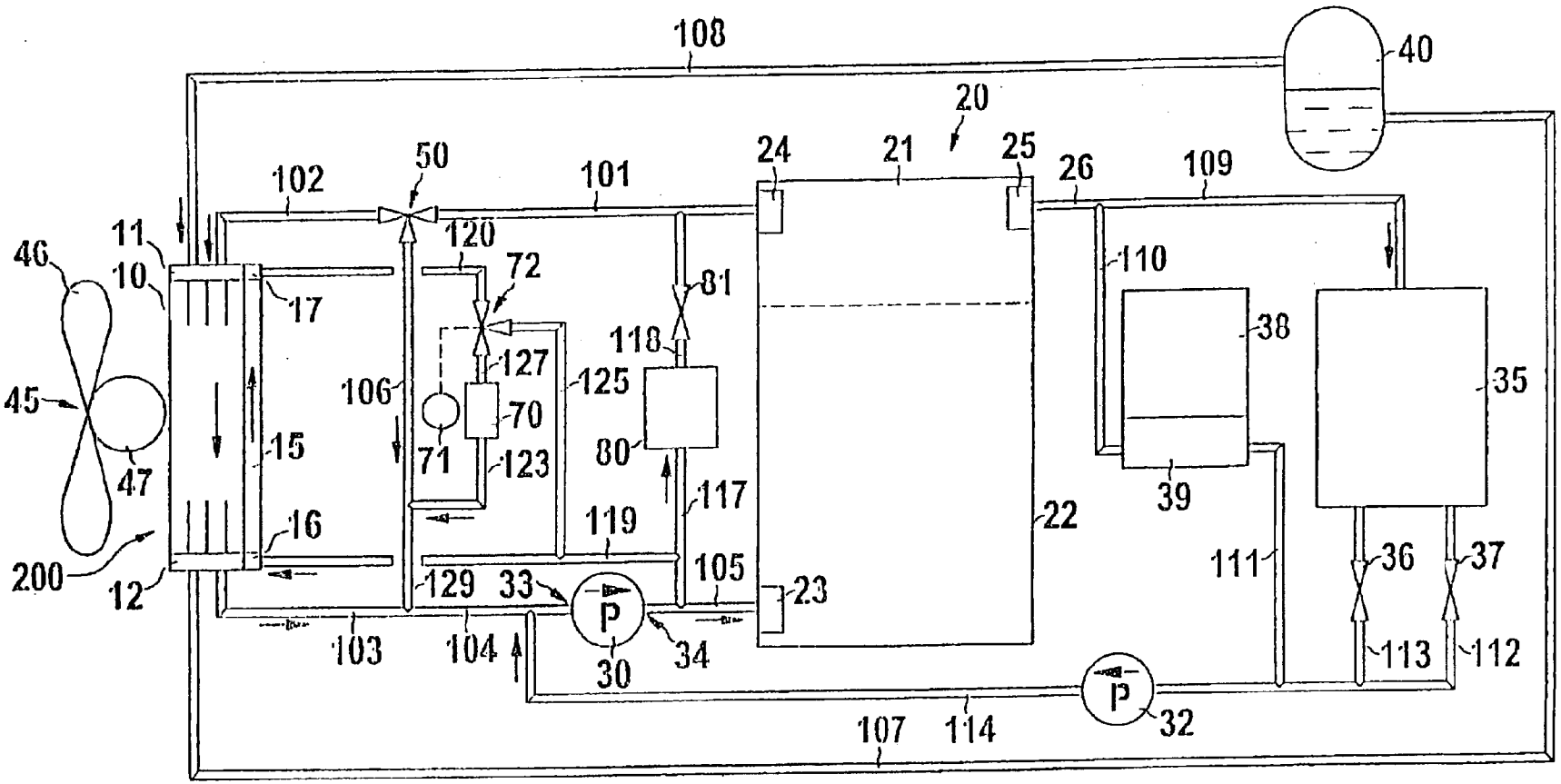
FIG. 1 shows a first embodiment of the cooling system according to the invention, which contains a first unit in the form of a power electronics circuit and a second unit in the form of an oil cooler.
Figure 2:
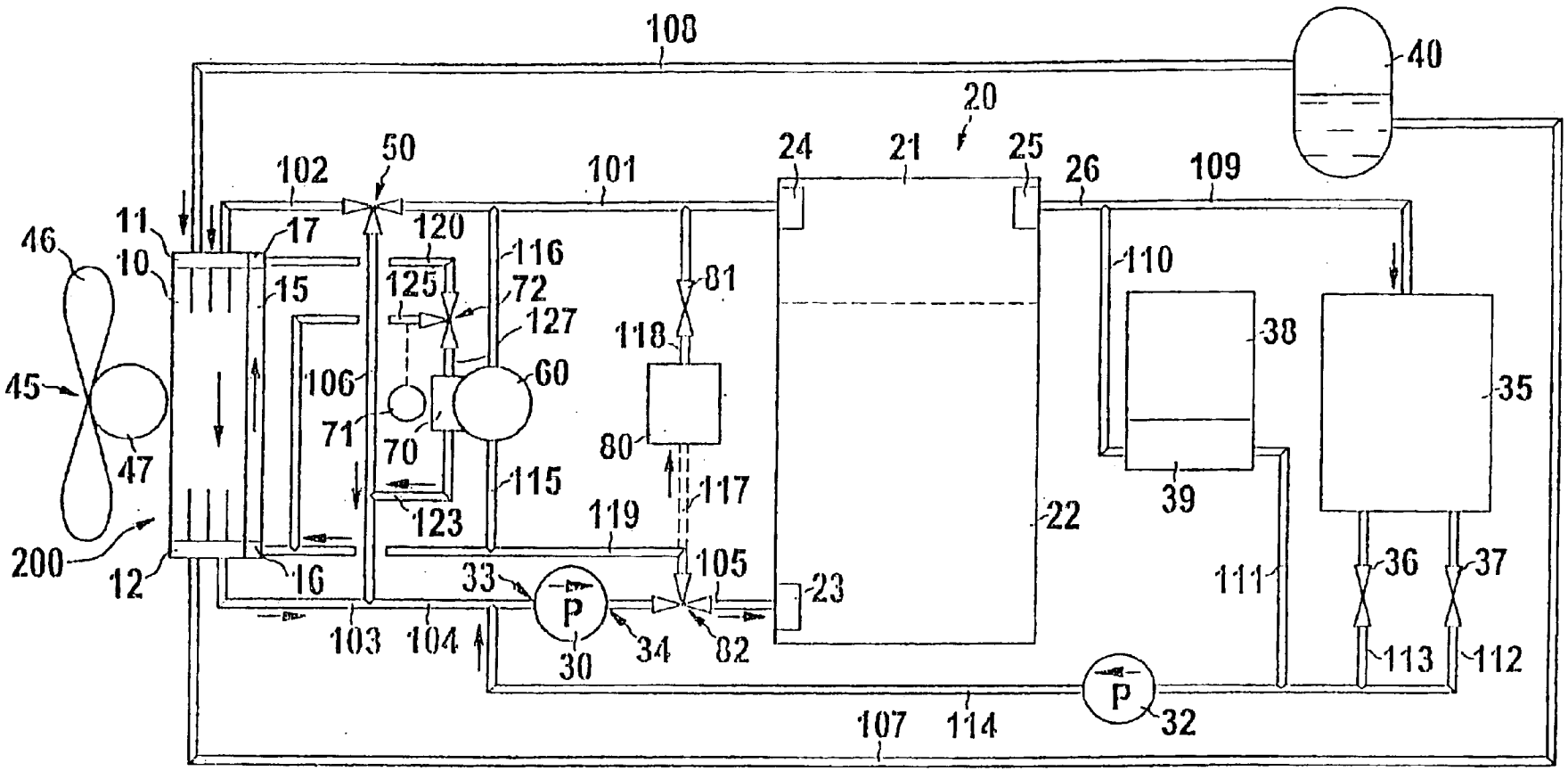
FIG. 2 shows a second embodiment of the cooling system according to the invention, which contains a first unit in the form of a power electronics circuit and two second units in the form of an oil cooler and a starter generator, wherein the power electronics circuit is associated with the starter generator.
Figure 3:
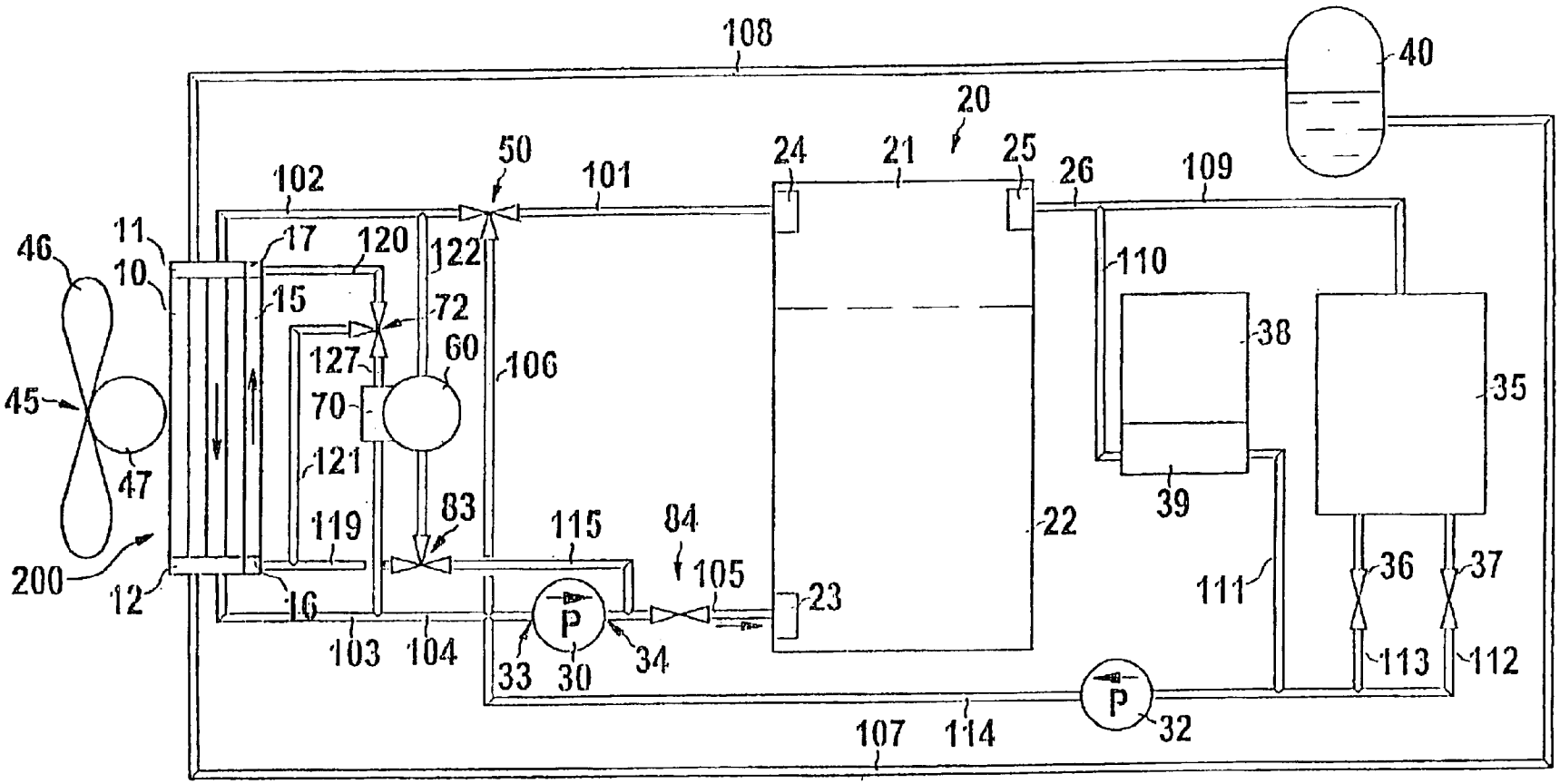
FIG. 3 shows a third embodiment of the cooling system according to the invention, which contains a first unit in the form of a power electronics circuit and a second unit in the form of a starter generator, wherein the power electronics circuit is associated with the starter generator.

The first description will be of those components of the apparatus according to the invention for cooling and/or heating a motor vehicle, which are essentially the same for the embodiments according to FIGS. 1 to 3.

In the embodiments of the cooling system according to the invention shown in FIGS. 1 to 3, the apparatus includes a main cooler segment 10, which has a main cooler inlet 11 and a main cooler outlet 12. Adjacent to the main cooler segment 10, there is a cooling fan 45. The cooling fan 45 has a fan 46 and a fan motor 47. A compensation receptacle 40 is connected to the main cooler inlet 11 via a line section 108 and is connected to the main cooler outlet 12 via a line section 107.

The apparatus according to the invention, which is also referred to below in the same sense as a cooling system, serves primarily to cool an internal combustion engine 20. In a simplified representation, the engine 20 has a cylinder head 21 and an engine block 22. A coolant inlet 23 leads into the engine block 22, and a coolant outlet 24 and an additional coolant outlet 25 lead back out of the cylinder head 21 of the engine 20. The connecting lines between the coolant inlet and the two coolant outlet openings shown are not depicted in further detail for the sake of clarity. The coolant outlet 24 of the internal combustion engine 20 is connected to the main cooler inlet 11 via a line section 101, a mixing valve 50, and a line section 102.

The mixing valve 50 can, for example, be an intrinsically known thermostatic valve. Alternatively, a regulatable or controllable servo valve can be used for the mixing valve 50, which is actuated, for example, by a control unit 227 that is not shown in FIGS. 1, 2, or 3. The coolant inlet 23 of the internal combustion engine 20 is connected to the pressure side 34 of a coolant pump 30 via a line section 105. The suction side 33 of the coolant pump 30 is connected to main cooler outlet 12 via a line section 103 and a line section 104. The mixing valve 50 is associated with a short-circuit line 106, and the coolant outlet 24 of the engine 20 can be connected to the coolant inlet 23 via a line section 101, the mixing valve 50, the short-circuit line 106, a line section 104 (except in the embodiment according to FIG. 3), the coolant pump 30, and a line section 105. Consequently, the mixing valve 50, which is used by way of example in these embodiments in the form of a thermostatic valve, can be used to adjust or control the operating temperature of the engine 20. For example, the mixing valve 50 can completely or partially shut off the coolant supply to the main cooler segment 10 during the warm-up phase of the engine 20. This permits the operating temperature of the engine 20 to be reached more quickly than if the coolant were conveyed through the main cooler segment 10.

The cylinder head 21 of the engine 20 has a heat connection 26 via the coolant outlet 25. Coolant that has been heated by the engine 20 can be drawn from the heat connection 26. The heat connection 26 is connected to a heating system heat exchanger 35 via a line section 109. The heating system heat exchanger 35 conveys a flow of air, which is provided e.g. for heating the passenger compartment. In order to be able to adjust the temperature differently in the vicinity of the driver and for example a passenger, two outputs are associated with the heating system heat exchanger 35, the first of which has a first heat valve 36 and the second of which has a second heat valve 37. The first heat valve 36 and the second heat valve 37 can be used to influence the coolant flow passing through different regions of the heating system heat exchanger 35 so that this allows the temperature to be adapted differently e.g. for the left or right side of a vehicle. In the embodiment according to FIG. 1, the first heat valve 36 and the second heat valve 37 are respectively connected via line sections 113 and 112 to the suction side of a heating agent pump 32.

In the example shown, the heating agent and the coolant are constituted by one and the same medium, so that in principle, it is also possible to eliminate the use of a heating agent pump 32. In this case, the apparatus according to the invention for cooling and/or heating a motor vehicle can be operated by means of a single coolant pump 30.

The heat connection 26 of the engine 20 is also connected via a line section 110 to the heating agent inlet of a wiper fluid heat exchanger 39. The wiper fluid heat exchanger 39 is used to the heat the fluid contained in a wiper fluid receptacle 38 in order to prevent a wiper fluid system, not shown, from freezing. The outlet of the wiper fluid heat exchanger 39 is also connected via a line section 111 to the suction side of the heating agent pump 32.

According to the particular embodiment of the apparatus according to invention shown in FIG. 1, a first unit 70 to be cooled is provided, which is connected to the cooling system via a secondary cooler segment 15. In the embodiment shown, the secondary cooler segment 15 is contained along with the main cooler segment in a combined cooling module 200 in such a way that the cooling fan 45 can also act on the secondary cooler segment 15. The secondary cooler segment 15 has a secondary cooler segment inlet 16, which is connected to the pressure side 34 of the coolant pump 30 by means of line sections 119 and 117. In addition, the secondary cooler segment 15 has a secondary cooler segment outlet 17, which is connected to the coolant inlet of the first unit 70 via a line section 120.

The line section 120 is provided with a valve 72, which can be used to influence the quantity of coolant supplied to the first unit 79. The valve 72 in the form of a regulatable mixing valve is connected to the secondary cooler segment inlet 16 via a bypass line 125 and a part of the line section 119. By way of a first line section 119, the bypass line 125, the mixing valve 72, and a line section 127, the coolant can thus be conveyed through the first unit 70 and can be correspondingly heated there. By way of a line section 123, the line section 129, the line section 104, the coolant pump 30, and a line section 105, the coolant thus heated can be supplied to the engine 20 via the coolant inlet 23, for example. Consequently, the secondary cooler segment 15 can be bypassed if necessary during the starting and warm-up phase of the engine, thus allowing the full thermal output of the first unit to be used to accelerate the warm-up phase of the engine.

In addition, the first unit 70 is associated with a temperature sensor 71, which detects the temperature of the first unit 70 or the temperature of a temperature-sensitive component of the unit 70 and sends it as needed to a control unit 227. The temperature sensor 71 and the bypass valve 72 make it possible to adjust the operating temperature of the first unit 70 in a regulated fashion.

Since the coolant coming out of the main cooler segment 10 first flows through the secondary cooler segment 15 before being supplied to the first unit 70, the first unit 70 can be operated at a significantly lower temperature than the engine 20. As a rule, the coolant coming out of the first unit 70 has a temperature, which is still low enough to cool the engine 20.

In the particular embodiment of the apparatus according to invention shown in FIG. 1, the first unit 70 can be constituted, for example, by a circuit, in particular a power electronics circuit, which must be operated at temperatures significantly lower than the engine 20.

In the cooling system according to the invention, according to the embodiment shown in FIG. 2, a second unit 80 in the form of an oil cooler, for example, is connected in parallel to the engine 20. To this end, the coolant inlet of the oil cooler 80 is connected to the pressure side 34 of the coolant pump 30 via a valve 82 and a line section 117. The valve 82, which can be a thermostatic valve or also a mixing valve regulated by a control unit, makes it possible to regulate the volumetric flow of coolant through the second unit 80 as needed. Since the cooling capacity required by the engine 20 and that required by the second unit 80 can fluctuate to a considerable degree independently of each other, the volumetric flow supplied by the water pump 30 can be distributed as needed to the engine 20 and the second unit 80 and, via the connecting line 115, to the second unit 60 as well. The coolant outlet of the oil cooler 80 (second unit) is connected via a connecting line 118 to a point between the mixing valve 50 and the coolant outlet 24 of the engine 20. Since the provision of the oil cooler 80 is optional, the line sections 117 and 118 are depicted with dashed lines in FIG. 2.

In addition to the oil cooler 80, another first unit 60 is also provided, which is embodied in the form of a starter generator. The starter generator 60 is likewise connected in parallel with the engine 20. The coolant inlet of the starter generator 60 is connected to the pressure side 34 of the coolant pump 30 via the line section 115 and the valve 82. The coolant outlet of the starter generator 60 is connected via a line section 116 to a point between the mixing valve 50 and the coolant outlet 24 of the engine 20. As an option, an additional valve associated with the starter generator 60 can be provided in the line section 115 or in the line section 116 in order to influence the volumetric flow of coolant.

The starter generator 60 has a power electronics circuit 70, which must be operated at temperatures significantly lower than the starter generator 60. Therefore in the embodiment of the apparatus according to the invention shown in FIG. 2, a secondary cooler segment 15 is provided, which is spatially adjacent to the main cooler segment 10. This allows the cooling fan 45 to also act on the secondary cooler segment 15. The secondary cooler segment 15 has a secondary cooler segment inlet 16, which is connected to the pressure side 34 of the coolant pump 30 via a line section 119 and a line section 115. The secondary cooler segment 15 also has a secondary cooler segment outlet 17, which is connected via a line section 120 to the coolant inlet of the power electronics circuit 70.

In this embodiment, the power electronics circuit 70 constitutes a first unit to be cooled, which is connected to the cooling system via the secondary cooler segment 15. The line section 120 is once again provided with a valve 72 that serves to adjust the quantity of coolant used to cool the power electronics circuit 70 and also serves to set the operating temperature of the power electronics circuit 70. In addition, by means of a bypass line 125, the valve 72 makes it possible to regulate the coolant quantity flowing through the secondary cooler segment 15 as needed. In particular, the bypass valve 72 and the bypass line 125 make it possible to bypass the secondary cooler segment 15 in order not to prevent heat from being dissipated by means of the cooler, for example during the warm-up phase of the engine. In this case, the quantity of heat imparted to the coolant by the power electronics circuit 70 can be conveyed to the engine 20 via a line section 123, a line section 106, a line section 104, the coolant pump 30, and a line section 105 in order to thus thermally promote the warming up of the engine.

The power electronics circuit 70 is also associated with a temperature sensor 71, which is preferably situated in the most heat-sensitive region of the power electronics circuit 70. The power electronics circuit 70 can advantageously also have circuit components, which are provided in order to evaluate the temperature detected by the temperature sensor 71 and a corresponding signal that is to be monitored. A particularly effective apparatus is produced if corresponding circuit components actuate the valve 72 in a regulating fashion as a function of the temperature detected by the temperature sensor 71. A control unit not shown in detail in FIG. 2 can also be used for this purpose and, in addition to the parameters of the cooling system supplied by the temperature sensor 71, also queries other sensors in order to thus permit the regulatable valves of the cooling system to control the volumetric flows of coolant in an optimized manner.

The embodiment shown in FIG. 2 permits the starter generator 60 itself to be operated at a higher temperature level than the power electronics circuit 70 associated with it. The apparatus according to the invention advantageously does not require an additional coolant pump for this purpose.

In order to avoid repetition, other system components of the apparatus according to the invention shown in FIG. 2 will not be discussed more explicitly here. The reader should refer to the corresponding description of these shared components given in conjunction with FIG. 1 and the general description of the underlying cooling system.

A description of the cooling system according to the invention shown in FIG. 3 is given below; the reader should refer to corresponding descriptions given above with regard to the system components shared by the embodiments in FIGS. 1 to 3. In order to avoid repetition, the discussion below will center solely on the relevant differences from the above-described embodiments of the apparatus according to the invention.

FIG. 3 shows a third embodiment of the cooling system according to the invention. In this embodiment, a starter generator 60 constitutes a second unit to be cooled. In the embodiment shown in FIG. 3, the coolant outlet of the starter generator 60 is connected via a line section 122 to a point between the main cooler inlet 11 and the mixing valve 50. The coolant inlet of the starter generator 60 is connected via a line section 15 to the pressure side 34 of the coolant pump 30.

As an option, a mixing valve 83 can be provided at the coolant inlet of the starter generator 60. This mixing valve 83 makes it possible to regulate the volumetric flow of coolant through the starter generator 60 as needed. In this connection variant of the second unit (starter generator 60), the starter generator 60 can be operated at lower temperatures than the engine 20. To this end, even when the coolant pump 30 has a high delivery capacity, a valve 84 in the line section 105 can throttle the coolant flow through the engine 20 in order to increase the operating temperature of the engine 20. But in this connection variant, the waste heat of the starter generator 60 can only be used to a limited degree to shorten the warm-up phase of the engine 20 since heated coolant coming out of the starter generator 60 can only flow back to the cooling branch of the engine 20 via the main cooler segment 10.

The starter generator 60 is once again associated with a power electronics circuit 70, which constitutes a first unit that is connected to the cooling system via a secondary cooler segment 15. The secondary cooler segment 15 is once again spatially adjacent to the main cooler segment 10 so that a single cooling fan 45 can act on both the main cooler segment 10 and the secondary cooler segment 15. The secondary cooler segment 15 has a secondary cooler segment inlet 16, which is connected to the pressure side 34 of the coolant pump 30 via the line section 119, the valve 83, arid the line section 115. In addition, the secondary cooler segment 15 has a secondary cooler segment outlet 17, which is connected to a coolant inlet of the power electronics circuit 70 via a line section 120, a mixing valve 72, and a line section 127.

By means of the bypass line 125, the mixing valve 72 can be used as needed to regulate not only the volumetric flow passing through the power electronics circuit 70, but also the temperature of the coolant. To that end, the valve 72 can also be controlled on the basis of known status variables of the power electronics circuit 70, for example the current dissipated energy or the load profile of the associated starter generator 60. Alternatively, a temperature sensor can be provided, which detects the relevant, current temperature of thermally sensitive components of the power electronics circuit 70 and sends it to a control unit, not shown in FIG. 3, for the valve 72.

The coolant outlet of the power electronics circuit 70 is connected to the suction side 33 of the coolant pump 30 via a line section 121 and a line section 104. This connection supplies the coolant, which is heated by the power electronics circuit 70, to the coolant branch for the engine 20.

Figure 4:
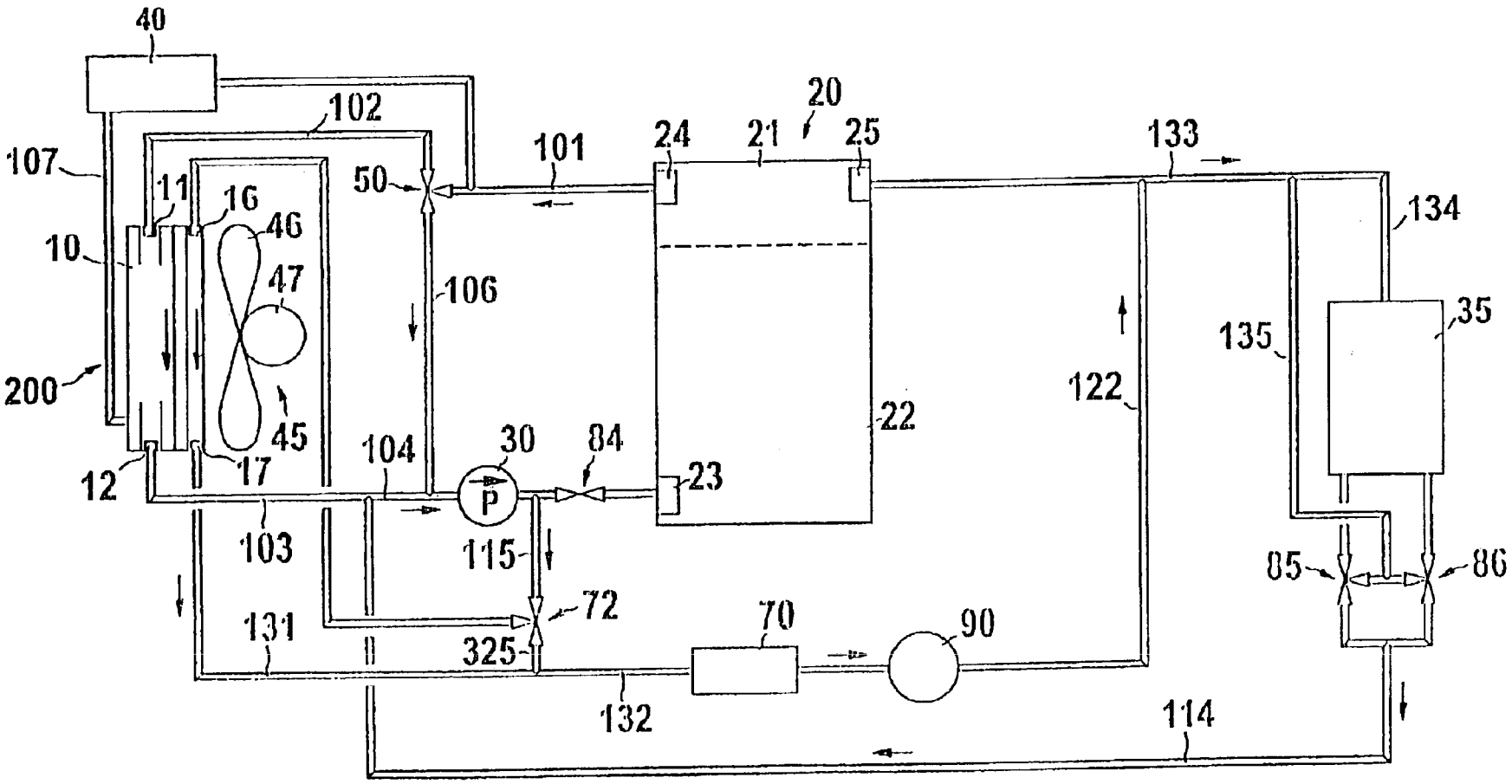
FIG. 4 shows a fourth embodiment of the cooling system according to the invention, which contains a first unit in the form of a power electronics circuit and a second unit in the form of a starter generator, wherein the power electronics circuit is associated with the starter generator.

In one exemplary embodiment of the apparatus according to the invention shown in FIG. 4, two first units, which are embodied in the form of a power electronics circuit 70 and an electric machine 90, are connected in series. The coolant flow is conveyed via a secondary cooler segment outlet 17, a connecting line 131, and the line section 132 through the units 70 and 90. The units 70 (power electronics circuit) and 90 (electric machine) are also connected to the main cooler segment 10 via a main cooler segment outlet 12, the connecting line 103, the connecting line 104, the coolant pump 30, the connecting line 115, a valve 72, a line element 325, and the line element 132. The mixing valve 72 between the line sections 115 and 325 makes it possible to adjust the relative volumetric flows of coolant from the main cooler segment 10 and the secondary cooler segment 15 as needed.

The coolant that is pumped through the units 70 and 90 is supplied to a heating system heat exchanger 35 for the passenger compartment of the vehicle via a connecting line 122, a line section 133, and a line section 134. In order to be able to adjust the temperatures differently for the driver and passenger regions, the heating system heat exchanger 35 is associated with two outlets, the first of which has a first heat valve 85 and the second of which has a second heat valve 86. The volumetric flow supplied to the heating system heat exchanger 35 can be regulated by means of a line connection 135, which extends between the heat valves 85 and 86 at the one end and the line section 133 at the other end. The first heat valve 85 and the second heat valve 86 are connected to the suction side of the coolant pump 30 via the connecting line 114. This makes it possible to operate the cooling and heating system with a single appropriately sized circulating pump 30.

A valve 84 can close off the coolant inlet 23 of the engine 20 from the cooling and heating circuit. This makes it possible to further reduce the coolant flow required in the vehicle when the engine 20 is not running. In addition, the waste heat of the two first units 70 and 90, which can for example be a power electronics circuit 70 and a generator 90, can be used to heat an interior, not shown, of a motor vehicle. In particular, this makes it easy to produce an auxiliary heating system using components that are already present in the vehicle.

Figure 5:
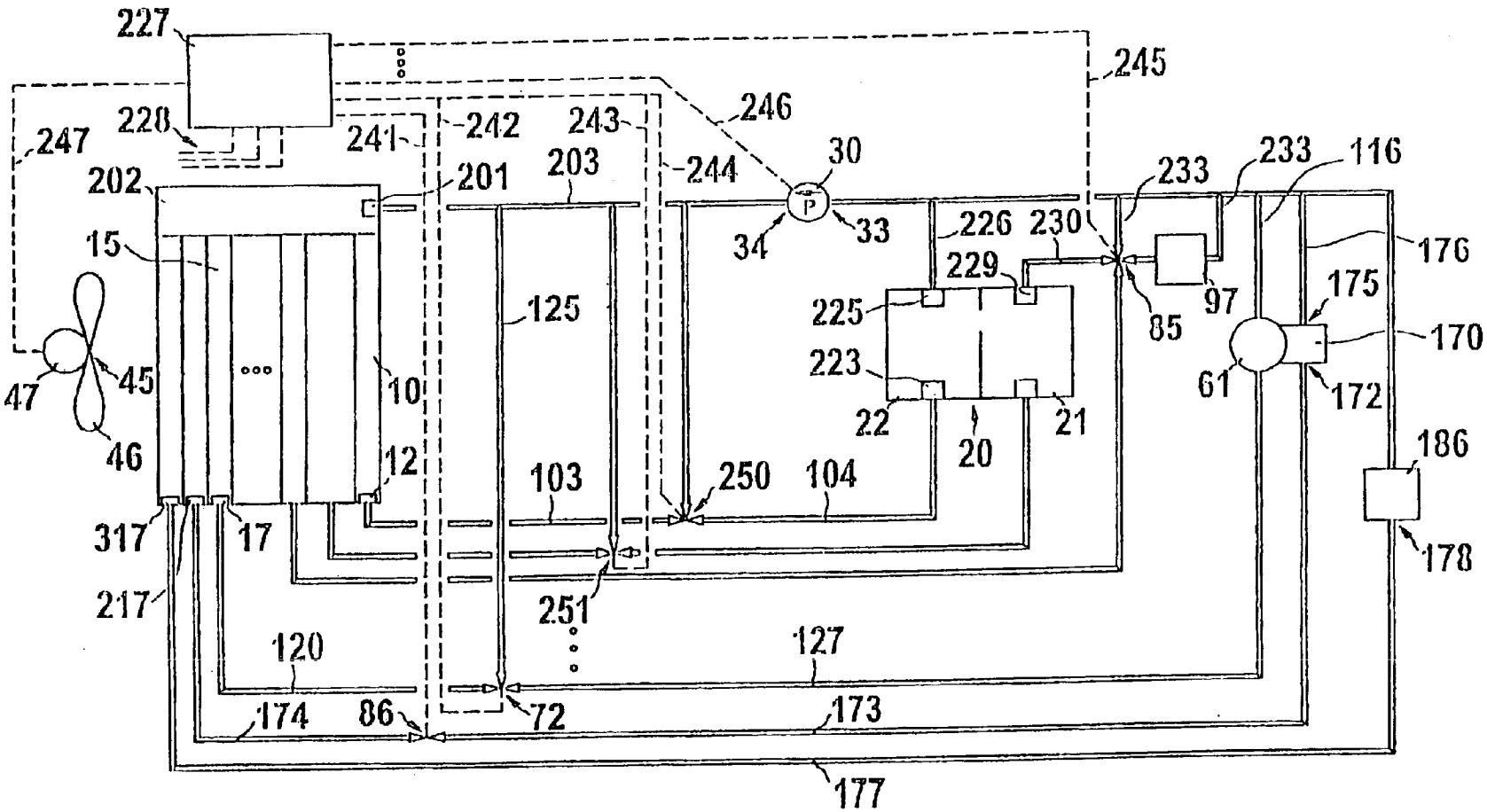
FIG. 5 shows a fifth embodiment of the cooling system according to the invention, in which a number of first units are disposed in parallel in the cooling system.

FIG. 5 shows another exemplary embodiment of the apparatus according to the invention for cooling and/or heating a motor vehicle. A main cooler segment 10 and a number of secondary cooler segments 15, 215, 315, 415, 515 are structurally integrated into a cooling module 200. The cooling module has a cooling module inlet 201 and a distributing box 202, which distributes the volumetric flow of coolant to the individual cooler segments of the cooling module. A coolant pump 30 pumps the volumetric flow of coolant through the cooling module 200 via a connecting line 203.

The cooler segments 10, 15, 215, 315, 415, 515, and other segments, which are also possible but are not shown for the sake of clarity, have separate cooler segment outlet openings 12, 17, 217, 317, 417, 517. The main cooler segment 12 is connected via a line section 103, a mixing valve 250, and a line section 104 to a coolant inlet 223 of an engine, in particular to its engine block 22. A connecting line 226 connects a coolant outlet 225 of the engine block to the suction side 33 of the coolant pump 30. The mixing valve 250 makes it possible to regulate the volumetric flow of coolant through an engine block 22 as needed. To that end, the mixing valve 250 can be operated by a control unit 227, which processes sensor signals 228 that are not shown in detail. These sensor signals can include the volumetric flow of the coolant, its temperature and pressure, and other physical parameters that describe the cooling and heating system.

Analogously, the engine head 21 can be acted on as needed with coolant by means of a cooler segment 415, a line section 228, a bypass valve 251, and a line section 229.

The secondary cooler segment 15 is connected by means of a secondary cooler segment outlet 17, a line section 120, a mixing valve 82, and a line section 127 to a first unit in the form of an electric machine 61. The coolant outlet of the electric machine 61 is connected via a line section 116 to the suction side 33 of the coolant pump 30. The relative volumetric flow of coolant through the secondary cooler segment 15 can be adjusted by means of the mixing valve 82 and the bypass line 125, which connects the mixing valve 82 to the pressure side 34 of the coolant pump 30. The regulating valve 82, which in principle can also be a thermostatic valve without active triggering, can be used as needed to supply the coolant, which has been cooled in the secondary cooler segment 15, to the components that are to be cooled, i.e. in this case the electric machine 61.

In the embodiment of the apparatus according to the invention shown in FIG. 5, the cylinder head 21 is followed by an additional unit 97, connected to-it via a connecting line 230. The unit 97 is in turn connected via a line section 232 to the pressure side 33 of the coolant pump 30. In this way, the waste heat of the cylinder head 21 can be used to more rapidly warm up the unit 97, which can, for example, be a gear oil receptacle. The mixing valve 85 makes it possible to disconnect the series connection of the cylinder head 21 and the unit 97 once again, for example during normal driving operation. To this end, the valve 85 can be embodied in the form of a four-way mixing valve. In this case, the valve 85 has a line connection 233 to the pressure side 33 of the coolant pump 30 as well as another connecting line 234 to a secondary cooler segment outlet 517 of a secondary cooler segment 515 of a cooling module 200.

Also shown in the cooling circuit according to the invention depicted in FIG. 5, is another first unit in the form of an electric circuit 170, which is associated with the electric machine 61. Since the electric circuit 170 in the exemplary embodiment shown does not have any specified requirements with regard to the volumetric flow of coolant, the temperature regulation of the coolant for the electric circuit 170 is executed by means of a two-way valve 86 and the throttling of the volumetric flow. To this end, the electric circuit 170 is connected on its inlet side 172 to a secondary cooler segment outlet 217 via a line section 173, the throttle valve 86, and a line section 174. On its outlet side 175, the electric circuit 170 is connected via a line section 176 to the pressure side 33 of the coolant pump 30.

The exemplary embodiment of the apparatus according to the invention for heating and cooling a motor vehicle, which is shown in FIG. 5, can be modified through the addition of other temperature subsystems situated in parallel with the coolant pump 30. The apparatus according to the invention allows one and the same cooling system to supply significantly different temperatures to the components contained in these temperature subsystems. The components to be cooled can, for example, also be connected directly to a secondary cooler segment without an exact temperature regulation, i.e. without a valve. At an example of this, in the exemplary embodiment in FIG. 5, an exhaust gas recirculation cooler 186 is connected via a line section 177 to a secondary cooler segment outlet 317 of a secondary cooler segment 315 of the cooling module 200. On its outlet side 178, the exhaust gas recirculation cooler 186 is connected via a line section 179 to the suction side 33 of the one coolant pump 30.

The coolant pump 30 delivers the coolant drawn in by its suction side 33 into the cooling module 200 via the line section 203 and the cooling module inlet 201. In the cooling module 200, the volumetric flow of coolant is distributed to the individual cooler segments in the manner described above. The division of the cooling module 200 into various segments 10, 15, 215, 315, 415, 515 can, for example, be simply and inexpensively embodied, for example by dividing up the collecting receptacle of the cooling module with dividing walls; a hose connection fitting is provided for each section. In other embodiments of the apparatus according to the invention, the valves 250,251, 82, 85, 86 can also be integrated directly into the cooler module. Alternatively, it is naturally also possible to use separate cooler segments.

The valves provided in the temperature subsystems, for example the regulating valves 250, 251, 82, 85, 86, can be triggered and adjusted by means of a central control unit 227, for example on the basis of known status variables of the components to be cooled, for example the current dissipated energy or the load profile of the electric machine or the associated circuit 170. For the triggering of the valves, electric connecting lines 241, 242, 243, 244, 245 are provided, which represent a connection of the control unit 227 to the regulating valves and which convey the corresponding adjustment signals to the actuators of the valves. Likewise, the control unit 227 can adapt the delivery capacity of the coolant pump 30 to the current requirements of the cooling and heating system by means of an electric connecting line 246 and can adapt the speed of a fan 45 associated with the cooling module 200 by means of a connection 247. To this end, various sensor signals 228 can be supplied to the control unit. Thus, for example, temperature sensors, pressure sensors, volumetric flow sensors, and sensors that detect other important parameters can be integrated into the cooling and heating system of the apparatus according to the invention in such a way that important physical variables of the units to be cooled are communicated to the control unit 227. The control unit 227 itself can have predetermined reference values or optimal operating ranges, for example in the form of characteristic fields stored in it, so that a comparison of the currently measured parameters to the stored optimal values makes it possible to derive an adjustment variable for the valves 250, 251, 82, 85, 86, the water pump 30, or also a cooling fan 45.

The apparatus for cooling and/or heating a motor vehicle according to invention is not limited to the embodiments shown in FIGS. 1 to 5.

The apparatus according to the invention is also not limited to the use of starters, generators, or starter generators as first units. Advantageously, the invention can be used for all electric machines that require cooling.

What is claimed is:

1. An apparatus for cooling and/or heating a motor vehicle, with at least one coolant pump for circulating a coolant in a cooling and heating system comprising a main cooler segment, which has a main cooler inlet and a main cooler outlet, wherein the main cooler inlet is at least intermittently connected to at least one coolant outlet of an engine to be cooled, and its main cooler outlet is connected to at least one coolant inlet of the engine, and with at least one other, secondary cooler segment provided in addition to the main cooler segment and at least one other unit to be cooled, which is connected to the cooling and heating system, and the apparatus has at least one bypass line with a bypass valve, which is associated with the at least one secondary cooler segment and is disposed parallel to this secondary cooler segment in the cooling and heating system of the motor vehicle.

2. The apparatus according to claim 1, wherein at least one first unit to be cooled is connected to the cooling and heating system via a secondary cooler segment.

3. The apparatus according to claim 1, wherein at least one second unit to be cooled is connected into the cooling and heating system of the motor vehicle parallel to a device selected from the group consisting of the engine, the main cooler, and both.

4. The apparatus according to one of claim 1, wherein the volumetric flow and/or the temperature of the coolant, which is pumped through at least one first unit and/or at least one second unit, can be varied by means of at least one valve mixing valve in a supply line of a unit selected from the group consisting of the at least one first unit, the at least one second unit, and both.

5. The apparatus according to claim 1, wherein one component of the apparatus is a control unit, which optimizes the adjustment of at least one regulatable or controllable valve through the use of at least one sensor signal.

6. The apparatus according to claim 5, wherein the control unit contains stored reference values, and triggers an actuator of at least one regulatable or controllable valve by comparing the at least one sensor signal to at least one associated reference value.

7. The apparatus according to claim 5, wherein the at least one sensor signal supplied to the control unit is the signal of a temperature sensor.

8. The apparatus according to claim 7, wherein the temperature sensor is associated with at least one first unit, a unit selected from the group consisting of a second unit, and both.

9. The apparatus according to claim 1, wherein the delivery capacity of the coolant pump can be regulated or controlled through the use of at least one sensor signal.

10. The apparatus according to claim 1, wherein a segment selected from the group consisting of the main cooler segment the at least one secondary cooler segment and both are associated with at least one cooling fan, and in that at least the temperature detected by a temperature sensor is taken into account in the control or regulation of the at least one cooling fan.

11. The apparatus according to claim 1, the coolant pump, wherein an element selected from the group consisting of the regulating valves, a cooling fan, and both that is provided can be controlled on the basis of known status variables of the units.

12. The apparatus according to claim 1, wherein the main cooler segment and the at least one secondary cooler segment are structurally integrated into a combined cooling module.

13. The apparatus according to claim 1, wherein a combined cooling module has a common inlet for the cooler segments that it contains.

14. The apparatus according to claim 12, wherein the cooler segments integrated into the combined cooling module are disposed parallel to one another in the cooling and heating system.

15. The apparatus according to claim 1, wherein a coolant pump is integrated into the cooling and heating system of the vehicle in such a way that it forces the coolant through the cooling module.

16. The apparatus according to claim 13, wherein combined cooling module has separate inlet conduits and separate outlet conduits for the cooler segments that it contains.

17. The apparatus according to claim 16, wherein at least one cooler segment has at least one secondary cooler inlet, which is connected to the pressure side of the coolant pump.

18. The apparatus according to claim 16, wherein at least one second unit is connected to the pressure side of the coolant pump.

19. The apparatus according to 12, wherein the combined cooling module and the bypass valves, which regulate the flow through the respective segments of the cooling module, are all structurally integrated into a combined cooler/valve module.

20. The apparatus according to claim 1, wherein at least two units are to be connected in series in the cooling and heating system.

21. The apparatus according to claim 1, wherein at least one unit is to be connected in series with a device selected from the group consisting of the engine, a third unit, and both.

22. The apparatus according to claim 1, wherein the at least one coolant inlet of the engine can be closed off by a valve.

23. The apparatus according to claim 21, wherein the third unit is a heating system heat exchanger for the interior of a motor vehicle.

24. The apparatus according to claim 1, wherein the first unit is an electric circuit of a set of power electronics associated with a generator, a starter generator device selected from the group consisting of a and an electric machine.

25. The apparatus according to claim 1, wherein the second unit is an electric machine, in particular a generator, a starter, or a starter generator.

26. The apparatus according to claim 1, wherein in the cooling and heating system contains exactly one coolant pump.

* * * * *